United States Patent [19]

Marschke

[11] 4,100,824

[45] Jul. 18, 1978

[54] ROTARY TOOL FOR DRIVING ENGLISH AND METRIC THREADED MEMBERS

[75] Inventor: Jon V. Marschke, Cloquet, Minn.

[73] Assignee: SURELAB Superior Research Laboratories, Inc., West St. Paul, Minn.

[21] Appl. No.: 693,103

[22] Filed: Jun. 4, 1976

Related U.S. Application Data

[63] Continuation-in-part of Ser. No. 554,721, Mar. 3, 1975, abandoned.

[51] Int. Cl.[2] ..... B25B 13/06
[52] U.S. Cl. ..... 81/121 R
[58] Field of Search ..... 81/121 R, DIG. 5

[56] References Cited

U.S. PATENT DOCUMENTS

| | | | |
|---|---|---|---|
| 445,451 | 1/1891 | Miller | 81/121 R |
| 639,243 | 12/1899 | Jaeger | 81/121 R |

FOREIGN PATENT DOCUMENTS

| | | | |
|---|---|---|---|
| 128,703 | 6/1950 | Sweden | 81/121 R |

*Primary Examiner*—Al Lawrence Smith
*Assistant Examiner*—James G. Smith
*Attorney, Agent, or Firm*—James R. Haller

[57] ABSTRACT

A rotary tool having an opening with a first set of peripheral notches providing bearing surfaces for engaging English size driving portions of threaded members and a second set of peripheral notches providing bearing surfaces for engaging metric size driving portions of threaded members.

3 Claims, 5 Drawing Figures

ROTARY TOOL FOR DRIVING ENGLISH AND METRIC THREADED MEMBERS

This is a continuation-in-part of U.S. application Ser. No. 554,721, filed Mar. 3, 1975 now abandoned.

BACKGROUND OF THE INVENTION

During the proposed and gradual conversion in the United States to the metric system, it is expected that two sets of rotary tools such as wrenches for driving threaded members such as nuts and bolts will be required, one set sized in the metric system and the other set sized in the English system. In certain cases, the use of a wrench or the like sized in one system to turn a bolt or nut having a head sized in the other system will cause damage to the bolt by rounding or scoring its driving head. This, for example, might occur if a 13/16 inch wrench were employed to turn a 19 mm. bolt head.

It would be desirable to provide a single rotary tool such as a socket wrench or box end wrench which would not only fit both a given English sized and a given metric sized nut or bolt, but which would, in addition, grasp the bolt or nut head with sufficient contact as to avoid scoring or turning down of the head.

SUMMARY OF THE INVENTION

The present invention provides a rotary tool for driving a threaded member such as a nut or bolt or the like which has a driving head sized in either the English or the metric system. The tool includes a head with an opening for reception of the head of a threaded member. The opening is provided with a first set of six peripheral notches for engagement with the head of a threaded member sized in the English system, and also with a second set of six notches interposed between the notches of the first set and sized for engagement with the head of a threaded member sized in the metric system. The transverse axes of the first and second sets of notches are in the same plane; that is, the adjacent notches are in side-to-side proximity with one another.

Desirably, the relationship of the English-sized notches to the metric-sized notches is given by the formula:

$$SM = 0.79375B$$

in which $B$ represents the number of 32nds of an inch in the English system, taken to the nearest integer, and $SM$ is the number of millimeters in the metric system, taken to the nearest integer.

DESCRIPTION OF THE PREFERRED EMBODIMENT

Figure 1:
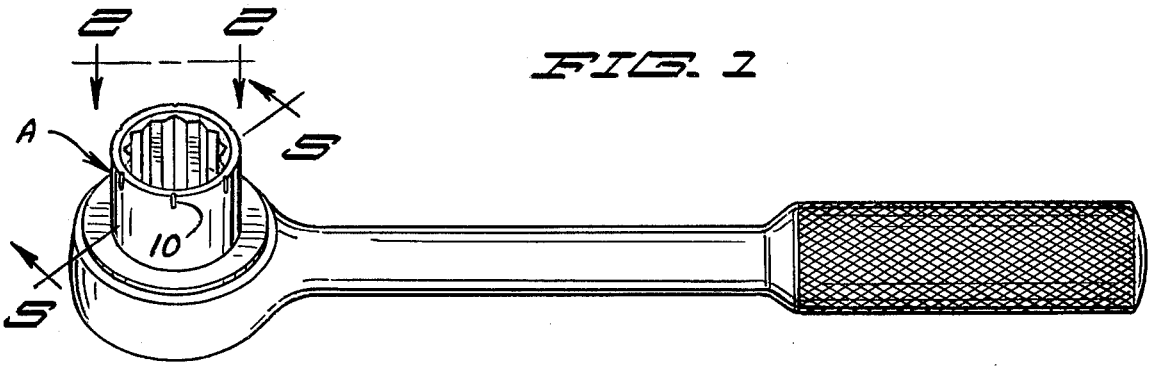
FIG. 1 is a perspective view of a socket wrench embodying the invention.

The rotary tool of the invention is exemplified in the drawing as a socket wrench having a socket head A provided with a peripherally notched socket opening. The notched opening, of course, may be provided in the head of a box end wrench or other rotary rool for driving nuts and bolts or the like. The socket head A is illustrated as useable for both a 13/16 inch hexagonal nut and a 21 mm. hexagonal nut as an example. Various other combinations of English and metric sized rotary tool openings are described below.

Figure 2:
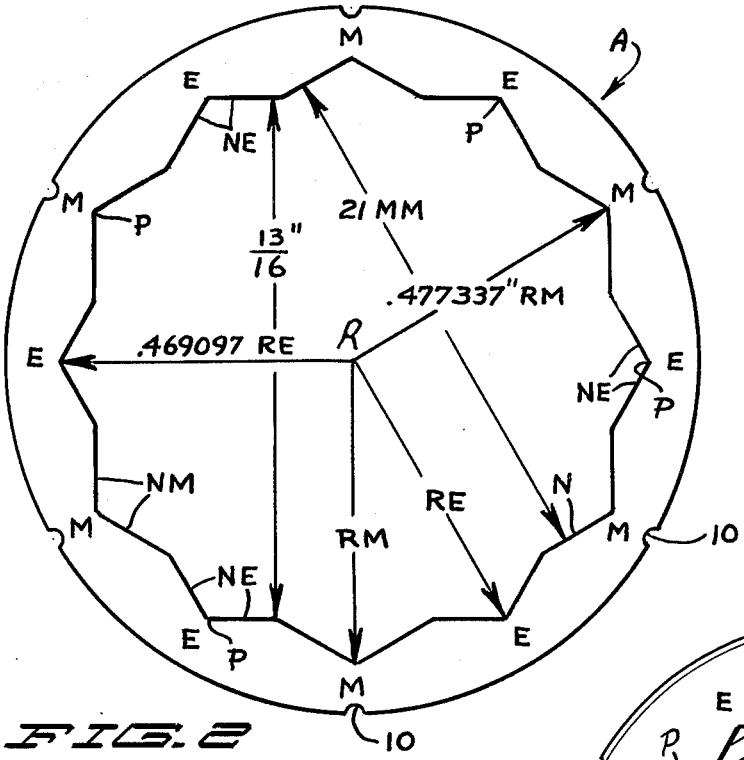
FIG. 2 is an enlarged view taken along line 2—2 of FIG. 1 and illustrating a socket sized at 13/16 inches in the English system and at 21 mm. in the metric system.
Figure 4:
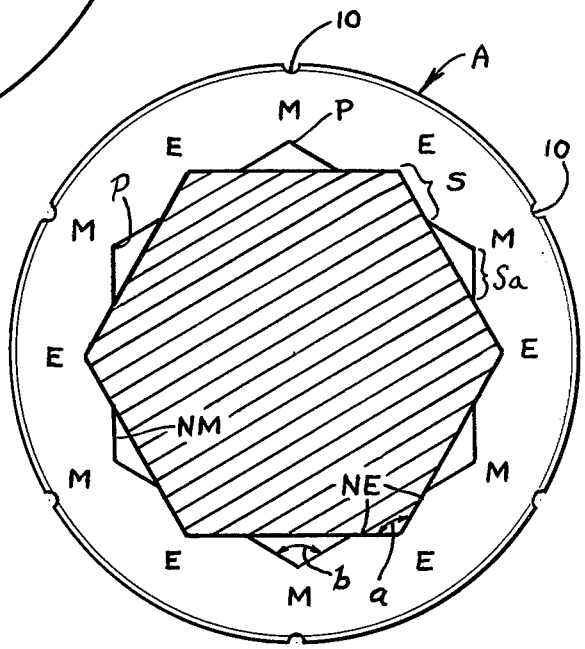
FIG. 4 is an illustration similar to that of FIG. 2 shown with a nut head in the socket.
Figure 5:
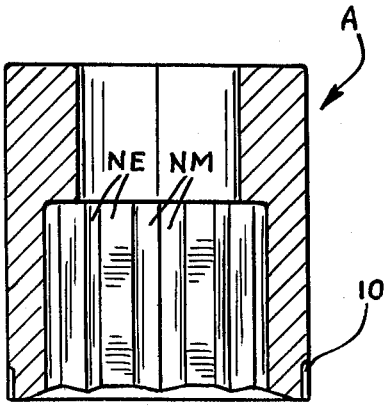
FIG. 5 is a cross-sectional view taken along line 5—5 of FIG. 1.

Referring particularly to FIGS. 2 and 4, the inner periphery of the opening of the socket is provided with six equally spaced V-shaped notches NE and six equally spaced V-shaped notches NM interposed between the notches NE. The latter notches are equally spaced between the notches NE, and all of the notches lie in a side-by-side configuration about the rotary axis of the socket. That is, a single plane normal to the axis of rotation intersects all of the notches. The notches NE and NM are used for threaded members such as bolts having hexagonal heads sized respectively in the English and in the metric system. With reference to FIG. 4, the angle $a$ formed by the side walls of the notches NE, and the single $b$ formed by the side walls of the notches NM, are that of a hexagonal formation; i.e., approximately 120°. Every vertex P of the angle $a$ of the notches NE is used for an English sized bolt or nut, and every other remaining vertex P of angle $b$ of the notches NM is used for a metric sized nut or bolt. In this manner, one peripherally notched opening exemplified by the socket head can be used for two different sized nuts, one in the English system and the other in the metric system, with entirely sufficient bearing length or contact of either nut with a given socket. Bearing length, taken in a plane normal to the axis of rotation of the notched opening, is illustrated in FIG. 4 as S.

Figure 3:
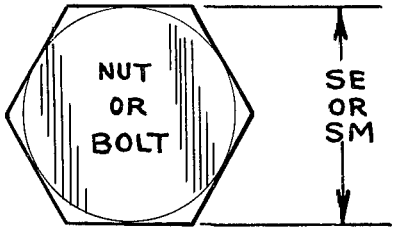
FIG. 3 is an isometric view of a hexagonal nut illustrating "nut size" measurements.

The vertices P of the sockets in FIG. 2 which are marked E are for nuts and bolts in the English system, and the vertices M are for nuts and bolts in the metric system. RE and RM designate the respective radial distances from the axis of rotation R of the notched opening to the vertices E and M, these radial distances being different. The metric or English size designations for the notches in the metric and English system are referenced to the distance across the "flats" of the driving head of a nut or bolt or the like as shown in FIG. 3, SE and SM referring respectively to the English and metric sizes of the driving head and of the notched opening represented by the socket head A which receives the driving head. It will be understood that some small clearance is ordinarily provided between the driving head of a nut or bolt and the socket or other notched opening which receives the driving head. For example, the dimension SE of a hexagonal headed bolt having a nominal head dimension between the flats of 7/16 inches may actually be 0.4375 inches – 0.4280 inches. The SE and SM dimensions described hereinafter, accordingly, refer to the nut sizes, and the distance separating those notched walls of the socket or other tool which contact the opposed flat surfaces of a nut or bolt head will be very slightly (e.g., 0.005 inches) larger. The sizes of the nut and bolt heads, and the sizes of the notched openings received in the heads, are nominally the same (i.e., within a few thousandths of an inch). For ease of calculation, the figures appearing below have been carried out to a number of decimal places; it will be understood, however, that the English and metric driving head sizes and notched opening sizes are reported as nominal figures such as 5/8 inches, 16 mm., etc.

Of importance to the present invention is the area of surface contact between the nut or bolt head and the socket or other notched opening, since the amount of torque which can safely be transferred from e.g., a socket to a e.g., bolt head without scoring or turning down the head depends very largely upon the area of contact (bearing area) between the socket and bolt head. The bearing area depends upon the height or thickness of a nut or bolt head (which is variable) and also the length of the bearing area measured in a plane normal to the axis of rotation of the socket. For any given bolt head and tool opening size, it will be now understood to be desirable to maximize the bearing length. With reference to FIG. 4, the bearing length of a bolt head with one wall of a single notch is designated S and S*a* in the English and metric systems, respectively. The total bearing length is 12S (referred to as $B_e$ in the accompanying table) or 12S*a* (reported as $B_m$ in the table). For comparison purposes, the total bearing lengths of conventional twelve point sockets meant solely for use with nut or bolt heads in the English system or in the metric system are given in the accompanying table and are denoted CBE (English system) and CBM (metric system).

The following table shows the results of calculations for a pairing, according to the invention, of English sized and metric sized notches in a peripherally notched tool opening such as a socket head. For example, in accordance with the invention, English sized notches for a 13/6 inch bolt head (SE) would be paired with metric sized notches for a 21 mm. (SM) bolt head.

TABLE

| English nut size $S_E$ inch | Radius to vertex $R_E$ inch | Metric nut size $S_M$ mm | Radius to Vertex $R_M$ inch | English bearing length $B_E$ inch | Metric bearing length $B_M$ inch | Conv. English bearing length $CB_E$ inch | Conv. Metric bearing length $CB_M$ inch |
|---|---|---|---|---|---|---|---|
| 3/16 | .108253 | 5 | .113652 | .235867 | .477648 | .348076 | .365434 |
| 1/4 | .144338 | 6 | .136382 | .629467 | .273168 | .464102 | .438522 |
| 9/32 | .16238 | 7 | .159112 | .590034 | .443688 | .522114 | .511608 |
| 5/16 | .180422 | 8 | .181843 | .550601 | .614232 | .580127 | .584695 |
| 11/32 | .198464 | 9 | .204573 | .511168 | .784752 | .63814 | .657782 |
| 3/8 | .216506 | 10 | .227303 | .471735 | .955272 | .696152 | .730868 |
| 7/16 | .252591 | 11 | .250034 | .865334 | .750815 | .812177 | .803957 |
| 15/32 | .270633 | 12 | .272764 | .825901 | .921337 | .87019 | .877043 |
| 1/2 | .288675 | 13 | .295494 | .786468 | 1.09186 | .928203 | .950129 |
| 9/16 | .324759 | 14 | .318225 | 1.18004 | .887401 | 1.04423 | 1.02322 |
| 19/32 | .342802 | 15 | .340955 | 1.14063 | 1.05792 | 1.10224 | 1.0963 |
| 5/8 | .360844 | 16 | .363685 | 1.1012 | 1.22844 | 1.16025 | 1.16939 |
| 11/16 | .396928 | 17 | .386416 | 1.49478 | 1.02398 | 1.27628 | 1.24248 |
| 23/32 | .41497 | 18 | .409146 | 1.45534 | 1.1945 | 1.33429 | 1.31556 |
| 3/4 | .433013 | 19 | .431876 | 1.41593 | 1.36502 | 1.3923 | 1.38865 |
| 25/32 | .451055 | 20 | .454606 | 1.3765 | 1.53554 | 1.45032 | 1.46174 |
| 13/16 | .469097 | 21 | .477337 | 1.33707 | 1.70609 | 1.50833 | 1.53482 |
| 7/8 | .505181 | 22 | .500067 | 1.73064 | 1.50161 | 1.62435 | 1.60791 |
| 29/32 | .523224 | 23 | .522797 | 1.69124 | 1.67213 | 1.68237 | 1.681 |
| 15/16 | .541266 | 24 | .545528 | 1.6518 | 1.84267 | 1.74038 | 1.75409 |
| 1 | .57735 | 25 | .568258 | 2.04538 | 1.63819 | 1.85641 | 1.82717 |

It will be noted in the example of a 13/16 inch English and 21 mm. metric socket, and with reference to the table herein, that the bearing length in a conventional English socket of 13/16 inch is 1.50833 inches while in the paired notched tool opening of the invention as exemplified by the socket A of the drawing, the bearing length of the 13/16 inch English socket is 1.33707 inches. This bearing length has been found to be entirely sufficient for contact or purchase with a nut or bolt head. Also, it will be noted that the bearing length of the conventional 21 mm. metric socket is 1.53482 inches, while in the combination tool of the invention, the bearing length of the 21 mm. socket is 1.70609 inches, which is quite sufficient for contact or purchase with a nut or bolt having a 21 mm. head. Thus, the 13/16 inch notches and the 21 mm. notches in a single notched opening or head provides sufficient bearing length for each socket in conjunction with a nut or bolt head. Other combinations set forth in the table also provide adequate bearing lengths for both metric and English notches in a single peripherally notched tool opening.

With reference to FIGS. 1, 2 and 4, the tool head A includes shallow recesses 10 formed in the outer surface of the head to designate the notches NM used for the metric sized nut or bolt heads, while the undesignated notches NE are used for the English sized nut or bolt head. Thus, the head A can be readily and correctly positioned on an English sized nut or a metric sized nut.

The sizes SE and SM of the notches which are paired in a single peripherally notched tool opening are desirably chosen in accordance with the formula:

$$SM = 0.79375B$$

in which *SM* represents the metric size in millimeters and *B* represents the number of 32nds of an inch in the English size, both SM and B being taken to the nearest whole integer.

For example, assume that the desired English size (SE) is ½ inch (i.e., 16/32). B is thus 16. Solving the equation, $SM = 12.7$ mm., or 13 mm. when taken to the nearest integer. Reversing the procedure, assume that the desired metric size is 13 mm. (SM). Solving the equation, B is found to be 16.4 (or 16, to the nearest integer), and SE is 16/32 or ½.

Thus, the English sized and metric sized notches in the rotary tools of the invention, when combined in the manner set out above, provide adequate bearing surfaces for torsional contact with nuts or bolts having respective English or metric-sized heads. In addition, it will now be understood that the English and metric sizes of the notches paired in tools of the invention are fairly close; that is, if an English sized bolt head is inadvertently captured in metric-sized notches, or vice versa, the resulting bearing surfaces may still be sufficiently large as to permit the bolt or nut to be turned without significant scoring of the head of the bolt or nut. For example, with reference to the above table, a bolt having a head with an SM of 11 mm. would fit in the English sized notches of a tool of the invention in which notches sized at 11 mm. and 7/16 of an inch are paired.

The following formulae were used in the calculations leading to the results summarized in the above table:

Radius to Vertex English $$R_E = \frac{S_E\sqrt{3}}{3}$$

Radius to Vertex Metric $$R_M = \frac{S_M\sqrt{3}}{3(25.4)}$$ ($R_M$ then in inches)

-continued

| | | | |
|---|---|---|---|
| Length of bearing English in the combination | $B_E = 24\left[R_E - \frac{S_M}{2(25.4)}\right]$ | Length of bearing Metric in the combination | $B_M = 24\left[R_M - \frac{S_E}{2}\right]$ ($B_M$ in inches) |
| Conventional bearing length English | $CB_E = 24\left[\frac{S_E\sqrt{3}}{3} - \frac{S_E}{2}\right]$ | Conventional bearing length Metric | $CB_M = 24\left[\frac{S_M\sqrt{3}}{3(25.4)} - \frac{S_M}{2(25.4)}\right]$ ($CB_M$ in inches) |

While I have described a preferred embodiment of the present invention, it should be understood that various changes, adaptations, and modifications may be made therein without departing from the spirit of the invention and the scope of the appended claims.

What is claimed is:

1. A rotary tool for driving a threaded member such as a nut or bolt or the like having a head sized in either the English or the metric system, the tool having an opening for reception of the head of the threaded member, the opening having a first set of six notches equally spaced about its periphery and sized for engagement with the English-sized head of a threaded member, and having a second set of six notches interposed between the notches of the first set and sized for engagement with a metric-sized head of a threaded member, all of the notches being intersected by a plane normal to the axis of rotation of the tool, and the relationship of the English sized notches to the metric sized notches being given by the formula $$SM = 0.79375B$$

wherein $SM$ represents the number of millimeters in the metric system, and $B$ is the number of 32nds of an inch in the English system, $SM$ and $B$ both being taken to nearest integers.

2. A rotary tool for driving a threaded member such as a nut or bolt or the like having a head sized in either the English or the metric system, the tool having an opening for reception of the head of the threaded member, the opening having a first set of six notches equally spaced about its periphery and sized for engagement with the English-sized head of a threaded member, and having a second set of six notches interposed between the notches of the first set and sized for engagement with a metric-sized head of a threaded member, all of the notches being intersected by a plane normal to the axis of rotation of the tool, and the notches sized in the metric system, expressed in millimeters, being paired with notches sized in the English system, expressed in inches, as follows:

5 mm paired with 3/16 inches
6 mm paired with ¼ inches
7 mm paired with 9/32 inches
8 mm paired with 5/16 inches
9 mm paired with 11/32 inches
10 mm paired with ⅜ inches
11 mm paired with 7/16 inches
12 mm paired with 15/32 inches
13 mm paired with ½ inches
14 mm paired with 9/16 inches
15 mm paired with 19/32 inches
16 mm paired with ⅝ inches
17 mm paired with 11/16 inches
18 mm paired with 23/32 inches
19 mm paired with ¾ inches
20 mm paired with 25/32 inches
21 mm paired with 13/16 inches
22 mm paired with ⅞ inches
23 mm paired with 29/32 inches
24 mm paired with 15/16 inches
25 mm paired with 1 inches.

3. A wrench head for a square drive wrench having in combination:

a. a square recess for receiving a square drive wrench,
b. a single socket for the reception of multisided threaded members,
c. said socket having a first set of six notches for engaging the driving portions of threaded members in the English system with equally spaced vertices, and
d. a second set of six notches interposed between the notches of said first set whose vertices are of different diameters from the diameters of the first set and in the metric system,
e. the transverse axes of said first and second sets of notches being in the same plane, and
f. designating means carried by the exterior of said head indicating and distinguishing the position of at least one of said sets of notches.

* * * * *